US006845702B2

(12) United States Patent
Sagawa et al.

(10) Patent No.: US 6,845,702 B2
(45) Date of Patent: Jan. 25, 2005

(54) HYDRAULIC CONTROLLER

(75) Inventors: Toyoaki Sagawa, Hyogo (JP); Kazuto Fujiyama, Hyogo (JP); Kimihiko Murase, Hyogo (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 34 days.

(21) Appl. No.: 10/381,966

(22) PCT Filed: Sep. 25, 2001

(86) PCT No.: PCT/JP01/08284

§ 371 (c)(1),
(2), (4) Date: Jun. 24, 2003

(87) PCT Pub. No.: WO02/29256

PCT Pub. Date: Apr. 11, 2002

(65) Prior Publication Data

US 2004/0040294 A1 Mar. 4, 2004

(30) Foreign Application Priority Data

Sep. 29, 2000 (JP) ..... 2000-299340
Oct. 3, 2000 (JP) ..... 2000-303699

(51) Int. Cl.[7] ..... F15B 11/16
(52) U.S. Cl. ..... 91/446; 60/422; 60/426
(58) Field of Search ..... 91/446; 60/422, 60/426

(56) References Cited

U.S. PATENT DOCUMENTS 5,138,837 A 8/1992 Obertrifter et al.
5,481,872 A 1/1996 Karakama et al.
5,890,362 A * 4/1999 Wilke ..... 60/427
6,334,308 B1 * 1/2002 Sato et al. ..... 60/422
6,584,770 B2 * 7/2003 Tsuruga et al. ..... 60/422
6,782,697 B2 * 8/2004 Mather ..... 60/422

FOREIGN PATENT DOCUMENTS

EP 0 536 398 B1 7/1996
EP 0 516 864 B2 12/2001
JP 04-194468 A1 7/1992
JP 07-139506 A1 5/1995

OTHER PUBLICATIONS

Translation of the International Search Report for PCT/JP01/08284 from The International Bureau of WIPO dated May 12, 2003.
International Search Report for PCT/JP01/08284 from the Japanese Patent Office dated Dec. 4, 2001.

* cited by examiner

*Primary Examiner*—Edward K. Look
*Assistant Examiner*—Igor Kershteyn
(74) *Attorney, Agent, or Firm*—Marshall, Gerstein & Borun LLP

(57) ABSTRACT

The present invention intends to improve a hydraulic control unit and prevent the occurrence of hunting as well as to reduce the size of the hydraulic control unit.

The hydraulic control unit is used in a several-directional-control-valves-assembled-type hydraulic control system 1 having a load sensing function. The hydraulic control unit has a PLS port. The PLS port is supplied with a maximum load pressure in the hydraulic control system. The compensator of the hydraulic control unit includes a metering orifice imparted with a function equivalent to a check valve. The compensator is imparted with the function of a shuttle valve (directional control valve), and by allowing the shuttle valve to operate independently of the compensator the pressure PLS is adjusted constantly.

26 Claims, 12 Drawing Sheets

HYDRAULIC CONTROLLER

DESCRIPTION

1. Technical Field

This invention relates to hydraulic control units for use in hydraulic control systems used in construction machines such as a hydraulic excavator and a hydraulic crane for example.

2. Background Art

Conventionally, several-directional-control-valves-assembled-type hydraulic control systems have been used in construction machines such as a hydraulic excavator and a hydraulic crane. This type of control system is adapted to supply pressurized fluid delivered from a single fluid feed pump to a plurality of hydraulic control units to drive actuators connected to the respective hydraulic control units.

Among such hydraulic control systems, one having a load sensing function is known (see Japanese Unexamined Patent Laid-Open Publication No. MEI 6-58305 for example). This function is as follows.

This hydraulic control system uses a variable displacement hydraulic pump and treats the highest one of pressures of pressurized fluid supplied to respective actuators (hereinafter referred to as "maximum load pressure PLS") as a feedback control value. The hydraulic pump is controlled so that the difference between the delivery pressure P of the hydraulic pump and the maximum load pressure PLS is held constant.

A hydraulic control unit having the aforementioned load sensing function includes a metering orifice adapted to open to an extent corresponding to the pressure of fluid supplied as a pilot pressure or the amount of a manual operation, a compensator for controlling the pressure difference between the upstream and downstream sides of the metering orifice to a constant value, and a check valve disposed between the output port of pressurized fluid and each pump port. This check valve serves to prevent back flow of pressurized fluid FIG. 13 is a sectional view of a conventional hydraulic control unit 500. The hydraulic control unit 500 is for use in a several-directional-control-valves-assembled-type hydraulic control system having a load sensing function. The hydraulic control unit 500 includes a body 501, a spool valve 502, flow paths 530 to 538 associated with the spool valve 502, a pump port 510, a maximum load pressure port (PLS port) 513 in communication with a pressure chamber 515, a tank port 511, a compensator 507 biased downwardly in the figure by a spring 514 provided in the pressure chamber 515, a shuttle valve 504 formed integral with the compensator 507, check valves 503*a* and 503*b*, and relief valves 505 and 506.

As shown, the spool valve 502 has a plurality of reduced-diameter portions, and a notch portion serving as a metering orifice. The spool valve 502 provides communication between the pump port 510 and the flow path 530 when it slides to the left, and allows an increasing amount of fluid to be fed to the flow path 530 with increasing amount of its sliding. Further, the sliding of the spool valve 502 to the left allows the flow paths 531 and 533 to communicate with each other, causes the communications between the flow path 533 and the flow paths 535 and 536 and between the flow path 532 and the flow path 534 to be interrupted, and allows the flow path 534 to communicate with the flow paths 537 and 538. The flow paths 537 and 538 mentioned here are connected to the tank port 511 and the relief valve 505, respectively.

When the spool valve 502 is caused to slide to the left in the figure, the pressure at the pump port 510 is outputted to a port A via the flow path 530, compensator 507, check valve 503*b*, flow path 531 and flow path 533. This port A is connected to an actuator not shown. In this case, fluid returning from the actuator not shown to a port B is discharged to the tank port 511 through the flow paths 534 and 537. In the event an accidentally high pressure is generated, the relief valve 505 is actuated to prevent the spool valve 502 from failing To the PLS port 513 is supplied the aforementioned pressure PLS. As described above, the pressure PLS is the highest one of the hydraulic pressures of fluid supplied to respective hydraulic control units forming the several-directional-control-valves-assembled-type hydraulic control system.

The PLS port 513 is in communication with the pressure chamber 515. In the pressure chamber 515 is accommodated the spring 514, which biases the compensator 507 downwardly.

The compensator 507 is biased downwardly by a force as the sum of a force PLS×S (wherein S is the area of the top surface of the compensator 507) which is generated by the action of the maximum load pressure PLS and a elastic force F of the spring which increases as the compensator 507 ascends (hereinafter, the force as the sum of these forces will be represented as "PLS×S+F"). The compensator 507 ascends when a force P1×S exerted on the bottom surface (area S) of the compensator 507 by the pressure P1 of fluid supplied to the flow path 530 becomes greater than the aforementioned force PLS×S+F. The compensator 507, which is provided with a metering orifice which opens as the compensator 507 ascends, is operative to adjust the pressure at the inlet of the compensator 507 (namely, the pressure P1 in the flow path 530) to a pressure substantially equal to the pressure PLS. Fluid having passed through the compensator 507 flows into the flow paths 531 and 532 through the respective check valve 503*a* and 503*b*. In this case the flow paths 531 and 532 communicate with the respective flow path 533 and 534 through respective openings formed by the movement of the spool valve 502 to the right and left in the figure.

The shuttle valve 504 is formed integral with the compensator 507. The shuttle valve 504 has a vertical hole 520 extending upwardly from the compensator 507 and a horizontal hole 521 intersecting the vertical hole 520. The horizontal hole 521 is configured so as to communicate with the PLS port 513 and the pressure chamber 515 only when the shuttle valve 504 ascends by a predetermined amount along with the compensator 507. When the shuttle valve 504 ascends by the predetermined amount with an increase in the pressure P1 in the flow path 530, the flow path 530 and the PLS port 513 come into communication with each other through the vertical hole 520 and the horizontal hole 521, so that the pressure P1 in the flow path 530 becomes the maximum load pressure PLS.

As described above, the hydraulic control unit 500 is provided with check valves 503*a* and 503*b* disposed between the compensator 507 and the respective ports A and B for preventing backflow of fluid having passed through the compensator 507. A space of a certain extent is necessary for the check valves 503*a* and 503*b* to be disposed, which hinders a reduction in the size of the hydraulic control unit 500.

In the above-described hydraulic control unit 500, the maximum load pressure PLS is renewed but not immediately after the pressure P1 in the flow path 530 has become higher than a maximum load pressure PLS working at other units. That is, the maximum load pressure PLS is not renewed until the force (P 1×S) exerted on the bottom surface (area S) of the compensator 507 by the hydraulic pressure in the flow path 530 has become higher than the force (PLS×S+F) as the sum of the force (PSL×S) exerted on the top surface (area S) of the compensator 507 by the pressure PLS and the elastic force F exerted by the spring 514 in a position raised by the aforementioned predetermined amount and, at the same time, the compensator 507 has made a given amount of stroke.

As a result, in the several-directional-control-valves-assembled-type hydraulic control system having the load sensing function the duration of the occurrence of a deviation between the maximum load pressure PLS, which is a signal pressure required to control displacement of the pump, and a maximum load pressure actually generated in the hydraulic control unit 500, is prolonged, and therefore hunting is induced easily in the system including the hydraulic control unit 500 and the pump.

DISCLOSURE OF INVENTION

An object of the present invention is to provide a hydraulic control unit for use in a several-directional-control-valves-assembled-type hydraulic control system having a load sensing function, which hydraulic control unit is of a reduced size and has the function of shortening the duration of the occurrence of a deviation between the aforementioned maximum load pressure PLS and an actual maximum load pressure in the hydraulic control unit.

To attain the aforementioned object, the present invention provides a hydraulic control unit for use in a several-directional-control-valves-assembled-type hydraulic control system having a plurality of actuators to be controlled by a variable displacement pump and provided with a load sensing function to detect a maximum load pressure, which is the highest one of load pressures working at the respective actuators, and to control a delivery pressure of the variable displacement pump so that the delivery pressure becomes higher by a predetermined value than the maximum load pressure detected, the hydraulic control unit having a maximum load pressure port to which the maximum load pressure in the hydraulic control system is supplied, the hydraulic control unit being characterized by comprising: a compensator including an input port connected to a first flow path communicating with a pump port through a variable orifice, an output port connected to a second flow path communicating with an output port of the hydraulic control unit connected to a predetermined one of the actuators, and a metering orifice having a variable opening for controlling a pressure in the first flow path according to a pressure in the second flow path; and a pressure chamber operative to exert a force in such a direction as to close the metering orifice; and a shuttle valve (directional control valve) which operates independently of the variable orifice and the compensator, and which performs a pressure control operation to reduce the pressure in the first flow path to the pressure in the second flow path and guides the pressure thus reduced to the maximum load pressure port when the pressure in the second flow path is higher than a maximum load pressure working at other hydraulic control units consisted of directional control valves in the hydraulic control system, wherein: the shuttle valve is incorporated in the compensator; and the shuttle valve has a function of sliding due to a deviation between the pressure at the maximum load pressure port and the pressure in the second flow path and guiding the pressure in the first flow path to the maximum load pressure port for use as the maximum load pressure by the sliding thereof, and a function of guiding the pressure at the maximum load pressure port to the pressure chamber of the compensator to close the metering orifice by the sliding thereof.

To attain the aforementioned object, the present invention further provides a hydraulic control unit for use in a several-directional-control-valves-assembled-type hydraulic control system having a plurality of actuators to be controlled by a variable displacement pump and provided with a load sensing function to detect a maximum load pressure, which is the highest one of load pressures working at the respective actuators, and to control a delivery pressure of the variable displacement pump so that the delivery pressure becomes higher by a predetermined value than the maximum load pressure, the hydraulic control unit having a maximum load pressure port to which the maximum load pressure in the hydraulic control system is supplied, the hydraulic control unit being characterized by comprising: a compensator including an input port connected to a first flow path communicating with a pump port through a variable orifice, an output port connected to a second flow path communicating with an output port of the hydraulic control unit connected to a predetermined one of the actuators, and a metering orifice having a variable opening for controlling a pressure in the first flow path according to a pressure in the second flow path; and a directional control valve which operates independently of the variable orifice and the compensator, and which provides communication between the second flow path and the maximum load pressure port when the pressure in the second flow path is higher than a maximum load pressure working at other hydraulic control units consisted of directional control valves in the hydraulic control system.

In each of the hydraulic control units described above, the shuttle valve may be incorporated in the compensator.

In the above-described hydraulic control unit, the shuttle valve may comprise: a first hole connected to the first flow path; a second hole connected to the maximum load pressure port; and a directional control valve which operates according to whether the pressure in the second flow path is higher or lower than the maximum load pressure supplied to the maximum load pressure port independently of the variable metering orifice and the compensator, which directional control valve provides communication between the first hole and the second hole when the pressure in the second flow path is higher than the maximum load pressure working at the other hydraulic control units consisted of directional control valves in the hydraulic control system, and which directional control valve is provided with a flow path for guiding the maximum load pressure working at the other hydraulic control units consisted of directional control valves in the hydraulic control system to the second hole while closing the first hole when the pressure in the second flow path is lower than the maximum load pressure working at the other hydraulic control units consisted of directional control valves in the hydraulic control system.

In the above-described hydraulic control unit, the directional control valve may comprise: a first hole connected to the second flow path; a second hole connected to the maximum load pressure port; and a piston which slides according to whether the pressure in the second flow path is higher or lower than the maximum load pressure supplied to the maximum load pressure port independently of the compensator, which piston provides communication between the first hole and the second hole when the pressure in the second flow path is higher than the maximum load pressure working at the other hydraulic control units consisted of directional control valves in the hydraulic control system, and which piston is provided with a flow path for guiding the maximum load pressure working at the other hydraulic control units in the hydraulic control system to the second hole while interrupting the communication between the first hole and the second hole when the pressure in the second flow path is lower than the maximum load pressure working at the other hydraulic control units consisted of directional control valves in the hydraulic control system.

The above-described hydraulic control unit may further comprise a check valve disposed between the input port and the output port of the compensator for blocking backflow of pressurized fluid from the second flow path to the first flow path.

The aforementioned compensator may be constructed to have a first surface on which the pressure in the first flow path works, an opposite second surface which has a larger area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

Alternatively, the aforementioned compensator may be constructed to have a first surface on which the pressure in the first flow path works, an opposite second surface which has a smaller area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

The hydraulic control unit according to the present invention is for use in a several-directional-control-valves-assembled-type hydraulic control system having a load sensing function. The hydraulic control unit has the maximum load pressure port to which the maximum load pressure in the hydraulic control system is supplied. The hydraulic control unit is characterized in that: the compensator included in the hydraulic control unit is imparted with a function equivalent to a check valve included in a conventional hydraulic control unit (for example, check valve 503*a*, 503*b* of the conventional hydraulic control unit 500 shown in FIG. 14[sic]); and the shuttle valve is provided as incorporated in the compensator for adjusting the maximum load pressure constantly by operating independently of the compensator; and the shuttle valve (selector valve) reduces the pressure in the first flow path to the pressure in the second flow path and guides the pressure thus reduced to the maximum load pressure port, the maximum load pressure being guided directly thereto while undergoing the pressure-reducing action of the shuttle valve (selector valve) reducing the pressure in the first flow path, i.e., the pump pressure.

By imparting the compensator with the function of a check valve, the number of parts can be reduced and, hence, the hydraulic control unit can be reduced in size. Further, the provision of the independently operating shuttle valve always allows the maximum load pressure in the hydraulic control system to be renewed, thereby preventing the occurrence of a deviation between the maximum load pressure in the hydraulic control system and an actual maximum load pressure in the hydraulic control unit.

BEST MODE FOR CARRYING OUT THE INVENTION

First Embodiment

Figure 1:
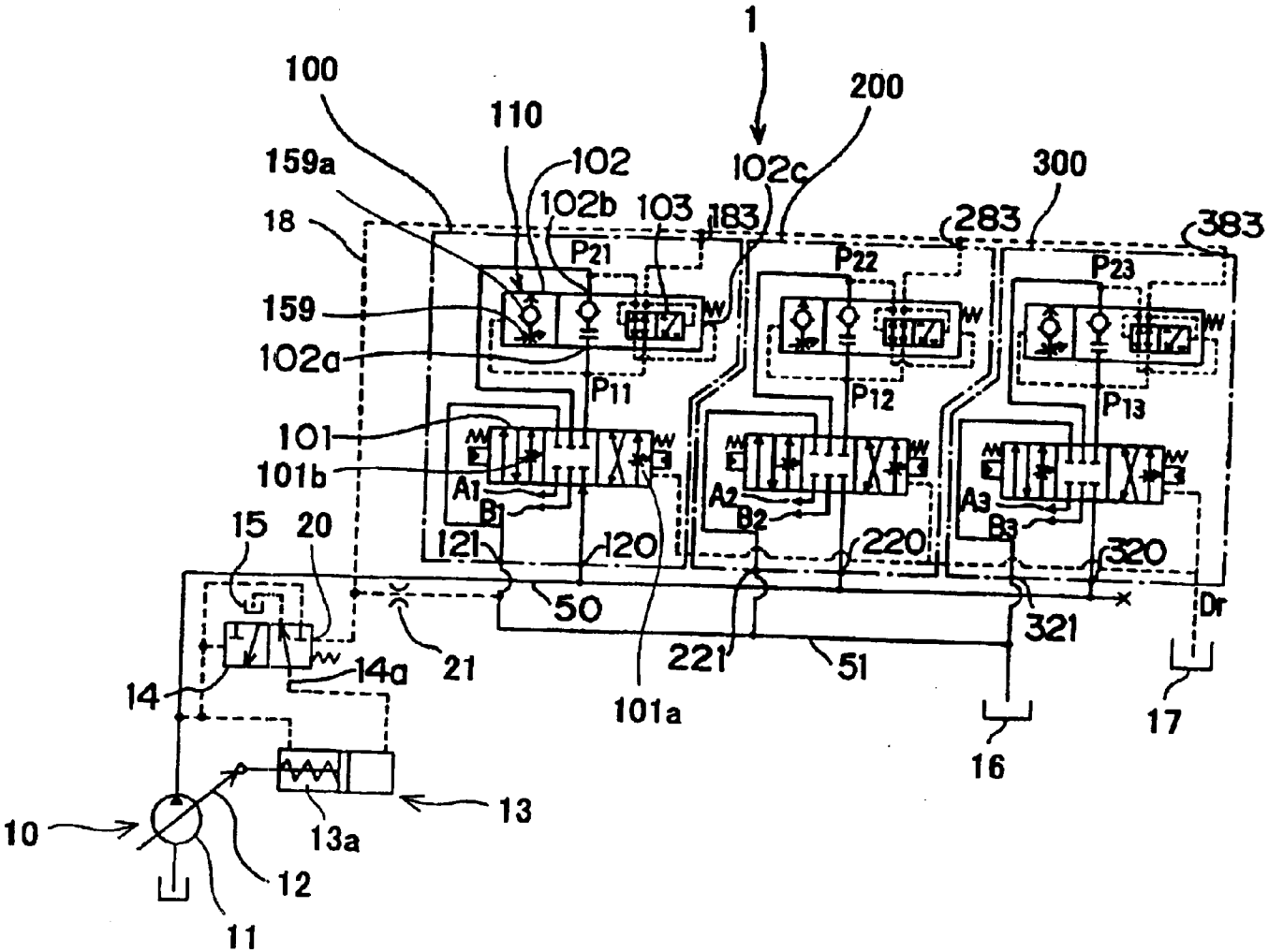
FIG. 1 is a hydraulic system diagram of a hydraulic control system according to a first embodiment of the present invention.
Figure 2:
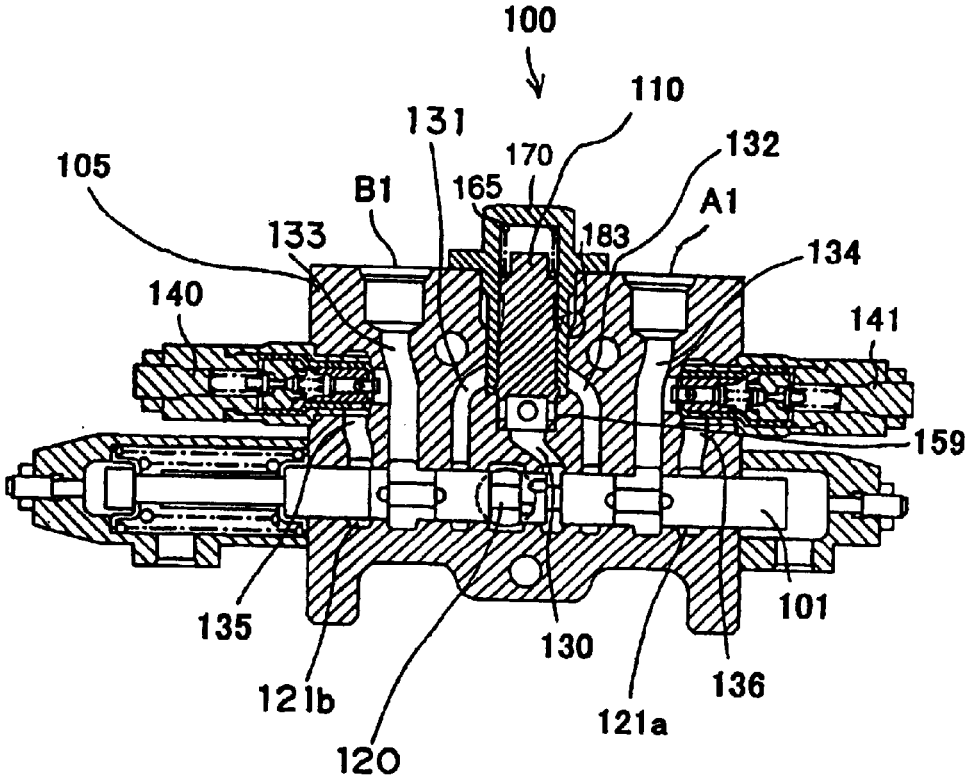
FIG. 2 is a sectional view showing the construction of a hydraulic control unit.
Figure 3:
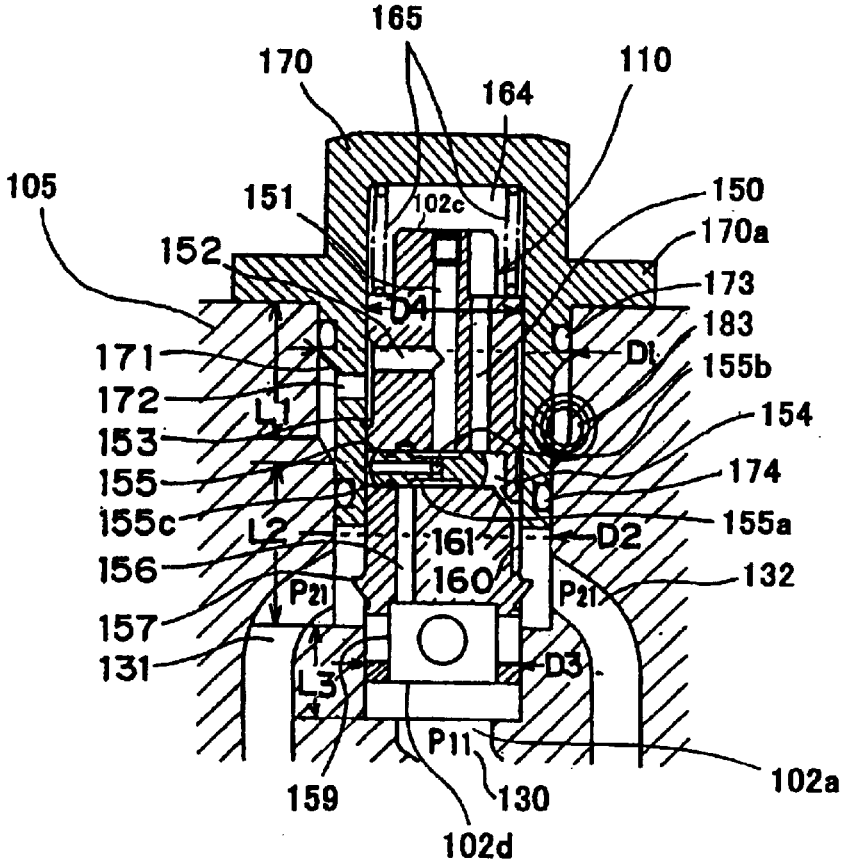
FIG. 3 is a detail view showing the construction of a control valve.

FIG. 1 is a hydraulic system diagram showing the configuration of a several-directional-control-valves-assembled-type hydraulic control system 1 employing hydraulic control units 100, 200 and 300 according to the first embodiment of the present invention. FIG. 2 is a sectional view of the hydraulic control unit 100 for specifically illustrating the construction of the hydraulic control unit 100. FIG. 3 is an enlarged view of a portion around a control valve 110 shown in FIG. 2.

A fluid supply line 50 extending from a variable displacement pump control section 10 is connected to pump ports 120, 220 and 320 of the respective hydraulic control units 100, 200 and 300. Tank ports 121, 221 and 321 of the respective hydraulic control units 100, 200 and 300 are connected to a discharged fluid tank 16 through a fluid discharge line 51. Maximum load pressure PLS ports (hereinafter referred to as "PLS port(s)" 183, 283 and 383 of the respective hydraulic control sections 100, 200 and 300 are connected to a PLS line 18. The PLS line 18 is connected to an input 20 of the variable displacement pump control section 10. A maximum load pressure PLS is inputted to the input 20.

The PLS line 18 is provided with a throttle valve 21. The throttle valve 21 serves to cause pressurized fluid (hereinafter referred to as "hydraulic fluid" when necessary) to flow constantly within the circuit in order to control the pressure working on a directional control valve 103. By the function of the throttle valve 21 a very small portion (about 1%) of hydraulic fluid flowing within the circuit is returned to the discharged fluid tank 16. The throttle valve 21 may be incorporated in a directional control valve 14 adapted to control displacement of the variable displacement pump (hereinafter referred to as "directional control valve") as a structure having the same function.

(1) Load Sensing Function Exercised by the Variable Displacement Pump Control Section The variable displacement pump control section 10 uses the value of a maximum load pressure PLS inputted to the input 20 as a feedback control value and controls delivery pressure P of a variable displacement pump 11 so that the difference between the value of the maximum load pressure PLS and the delivery pressure P of the variable displacement pump 11 (reference differential pressure Pref) is always held constant.

The variable displacement pump control section 10 comprises the variable displacement pump 11, a displacement control device 13, the directional control valve 14, and a tank 15.

The variable displacement pump 11 is provided with a feedback lever 12. By turning the feedback lever 12 counterclockwise in the figure, the delivery of the pump 11 is reduced. The upper end portion of the feedback lever 12 is connected to a control rod of the displacement control device 13. The control rod is provided with a spring 13*a*.

On the control rod of the displacement control device 13 are exerted a force working in the rightward direction in the figure by the pressure in a branch pipe provided in the fluid supply line 50, a force working in the leftward direction in the figure by the pressure guided from a lower port 14*a* of the directional control valve 14, and a spring force. Accordingly, the interaction of these forces causes the control rod to move to the right and left.

The directional control valve 14 has three ports and is capable of switching between two states. The directional control valve 14 is adapted to switch according to the relationship (whether greater or smaller) between a force as the sum of a force based on the delivery pressure P of the variable displacement pump 11 and the force of the spring 13*a* and a force based on a pressure (PLS+Pref) as the sum of the maximum load pressure PLS and the predetermined reference pressure Pref.

The variable displacement pump 11 has a spring working equivalently to the aforementioned pressure Pref. When the delivery pressure P of the variable displacement pump 11 is higher than the pressure (PLS+Pref), the directional control valve 14 switches into a connecting state shown on the left-hand side in the figure. Then, the hydraulic fluid delivered from the variable displacement pump 11 is fed into the right port of the displacement control device 13, so that the control rod of the displacement control device 13 moves to the left in the figure. By this movement the feedback lever 12 of the variable displacement pump 11 rotates counterclockwise to reduce the delivery of the variable displacement pump 11.

On the other hand, when the pressure (PLS+Pref) is higher than the delivery pressure P, the directional control valve 14 switches into a connecting state shown on the right-hand side in the figure. Then, hydraulic fluid is withdrawn from the right port of the displacement control device 13 into the tank 15, so that the control rod of the displacement control device 13 moves to the right. By this movement the feedback lever 12 of the variable displacement pump 11 rotates clockwise to increase the delivery of the variable displacement pump 11.

By such operations of the directional control valve 14 the difference between the maximum load pressure generated in the PLS line 18 and the delivery pressure P of fluid delivered from the variable displacement pump 11 is held constant at the predetermined reference value Pref.

(2) Hydraulic Control Unit

The hydraulic control system 1 includes the hydraulic control units 100, 200 and 300. These hydraulic control units 100, 200 and 300 are identical in construction with each other. The following description is directed only to the hydraulic control system 100.

Roughly speaking, the hydraulic control unit 100 is composed of a spool valve 101 and an integrated hydraulic control valve (hereinafter referred to as "control valve") 110.

The spool valve 101 opens variable orifices 101*a* and 101*b* to an extent corresponding to the amount of its sliding to cause hydraulic fluid fed to the pump port 120 to be outputted to the control valve 110 through the variable orifices 101*a* and 101*b*. Further, the spool valve 101 causes hydraulic fluid outputted from the control valve 110 to be outputted to a port A1 (output port of the hydraulic control unit) or a port B1 (output port of the hydraulic control unit) depending on the direction of its sliding (right or left).

The control valve 110 has functions corresponding to the functions of a compensator (for example compensator 507 of the conventional hydraulic control unit 500 shown in FIG. 14), a load check valve (for example load check valve 503*a*, 503*b* of the conventional hydraulic control unit 500 shown in FIG. 14) and a shuttle valve (for example shuttle valve 504 of the conventional hydraulic control unit 500 shown in FIG. 14), which are included in a conventionally known hydraulic control unit.

The control valve 110 comprises a compensator 102 and a directional control valve 103. The compensator 102 has two ports and is capable of switching between two states.

The selector switch 110 is disposed inside the compensator 102. The selector switch 103 has four ports and is capable of switching between two states. The directional control valve 103 functions independently of the compensator 102.

The compensator 102 switches from one state to the other depending on whether a total pressure to be described later (PLS+F/S or P21+F/S wherein S is the area of a working surface) is high or low. Actuation of the compensator 102 causes the area of the opening of a compensating part (metering orifice) 159 to be controlled, thereby controlling the pressure P11 of hydraulic fluid fed to the control valve 110. The total pressure, as used herein, means a pressure as the sum of the maximum load pressure PLS selectively outputted by means of the directional control valve 103 (to be described in detail later) and the pressure applied by a spring 165 (see FIG. 2) or as the sum of the pressure P21 in the second flow path 131 or 132 (see FIG. 2) and the pressure added by the elastic force F of a spring included in the control valve 110 (corresponding to spring 165 shown in FIG. 3).

When the pressure P11 is lower than the aforementioned total pressure (PLS+F/S), the pressure P11 works in such a direction as to close the spacing between an input port 102*a* and an output port 102*b*. As a result, the area of the opening decreases to control the pressure P11 so that P11 becomes equal to the total pressure, i.e., P11=(PLS+F/S). That is, the metering orifice 159 in the figure assumes a restricting state.

Alternatively, when the pressure P11 is higher than the aforementioned total pressure (PLS+F/S), the input port

102*a* is connected to the output port 102*b* via the metering orifice 159 opening to an extent corresponding to the value of the pressure P11 and a check valve 159*a* (engagement portion 159*a*). At this time, the opening of the metering orifice 159 becomes larger so that P11 becomes equal to the total pressure, i.e., P11=(P21+F/S).

The directional control valve 103 has four ports and is capable of switching between two states. The directional control valve 103 switches from one state to the other depending on whether the maximum load pressure PLS guided to the PLS port 183 is higher or lower than the pressure P21 of hydraulic fluid outputted from the output port 102*b* of the compensator 102.

When the maximum load pressure PLS is higher than the pressure P21, a line extending from the PLS port 183 becomes connected to input 102*c* of the compensator 102. On the other hand, when the maximum load pressure PLS is lower than the pressure P21, hydraulic fluid (pressure P11) fed to the control valve 110 is supplied to the maximum load pressure PLS port 183. Further, the pressure P11 is reduced to a pressure equal to the pressure P21 as will be described later, whereby the maximum load pressure PLS in the hydraulic control system 1 is renewed by replacement with the value of the pressure P21. In addition, a line extending from the output port 102*b* of the compensator 102 becomes connected to the input 102*c* of the compensator 102.

(3) Specific Construction of the Hydraulic Control Unit

Hereinafter, the specific construction and functions of the hydraulic control unit 100 will be described in detail.

The hydraulic control unit 100 includes a body 105, spool valve 101, flow paths 130 to 136 associated with the spool valve 101, pump port 120, tank ports 121*a* and 121*b*, PLS port 183, control valve 110 biased downwardly in the figure by spring 165, relief valves 140 and 141, port A1 (output port) and port B1. The construction of the control valve 110 and that of the portion thereabout, which are characteristic of the hydraulic control unit 100, will be described in detail with reference to an enlarged view (FIG. 3) later.

As shown, the spool valve 101 has a plurality of reduced-diameter portions and a notch portion serving as a metering orifice. When the spool valve 101 slides to the left in the figure, the pump port 120 and the flow path 130 communicate with each other. As the amount of sliding of the spool valve 101 increases, the openings of the respective variable orifices 101*a* and 101*b* increase to allow larger amounts of hydraulic fluid to flow therethrough.

The sliding of the spool valve 101 provides communication between the flow path 132 and the flow path 134 and between the flow path 133 and the flow path 135. The flow path 135 is connected in fluid communication with the tank port 121*b* and with the relief valve 140. Further, the sliding of the spool valve 101 causes communications between the flow path 134 and the flow path 136 and between the flow path 131 and the flow path 133 to be interrupted. The flow path 136 is connected in fluid communication with the tank port 121*a* and with the relief valve 141.

When the spool valve 101 slides to the left in the figure, hydraulic fluid fed to the pump port 120 is supplied to the port A1, passing through the flow path 130, metering orifice 159 of the control valve 110, flow path 132 and flow path 134. The port A1 is connected to an actuator not shown. Hydraulic fluid returning to the port B1 from this actuator is discharged to the tank port 121*b* through the flow path 133. It is to be noted that in the event an accidentally high pressure is generated, the relief valve 140 is actuated to prevent the spool valve 101 and the like from failing.

When the spool valve 101 slides to the right in the figure, the pump port 120 and the flow path 130 communicate with each other. As the amount of sliding of the spool valve 101 increases, the openings of the respective variable orifices 101*a* and 101*b* increase to allow larger amounts of hydraulic fluid to be fed therethrough.

The sliding of the spool valve 101 provides communications between the flow path 131 and the flow path 133 and between the flow path 133 and the flow path 135. The flow path 135 is connected in fluid communication with the tank port 121*b* and with the relief valve 140. Further, the sliding of the spool valve 101 causes communications between the flow path 134 and the flow path 136 and between the flow path 132 and the flow path 134 to be interrupted. The flow path 136 is connected in fluid communication with the tank port 121*a* and to the relief valve 141.

When the spool valve 101 slides to the right in the figure, hydraulic fluid fed to the pump port 120 is supplied to the port B1, passing through the flow path 130, metering orifice 159 of the control valve 110, flow path 131 and flow path 133. The port B1 is connected to the actuator not shown. Hydraulic fluid returning to the port A1 from this actuator is discharged to the tank port 121*a* through the flow path 134. It is to be noted that in the event an accidentally high pressure is generated, the relief valve 140 is actuated to prevent the spool valve 101 and the like from failing.

Since the shape and the operation of the spool valve 101 are not characteristic of the hydraulic control unit 100, further description thereof is omitted.

The control valve 110 is accommodated between a cylinder of a predetermined shape provided in the body 105 and a cover 170. As will be described later, a pressure chamber 164 is supplied with the highest pressure PLS within the hydraulic control system 1 from the PLS port 183 or the flow path 130. Accordingly, the control valve 110 is biased downwardly by a force (PLS×SD4+F) as the sum of a force PLS×SD4 (wherein SD4 is the area of the top surface having a diameter D4 of the control valve 110 on which the maximum load pressure PLS works) generated by the action of the maximum load pressure PLS, and a elastic force F of the spring 165 determined depending on the position of the control valve 110. At the same time, the control valve 110 is biased upwardly by hydraulic fluid flowing into the flow path 130 at a force P11×SD3 (wherein P11 is the pressure in the flow path 130 and SD3 is the area of the bottom surface having a diameter D3 of the control valve 110 on which the pressure P11 works).

Roughly speaking, the control valve 110 is composed of the shuttle valve, annular engagement portion 157 serving as a check valve, and metering orifice 159. The shuttle valve consists of holes 150, 151 (a flow path guiding a maximum load pressure working at other units), 152 (second hole), 154 and 156 (first hole), and piston 155.

The body 105 of the hydraulic control unit 100 has a first cylinder portion having a diameter D1 and a depth L1, a second cylinder portion having a diameter D2 and a depth 12, and a third cylinder portion having a diameter D3 and a depth L3, the first to third cylinder portions being located serially and coaxially. The first cylinder portion has a peripheral portion defining the PLS port 183. A joint portion extending between the first cylinder portion and the second cylinder portion is tapered. A joint portion extending between the second cylinder portion and the third cylinder portion defines a stepped portion. The second cylinder portion has a lower peripheral surface defining openings connected to the respective flow paths 131 and 132.

The cover 170 accommodating the control valve 110 in cooperation with the body 105 is of a substantially tubular shape of the diameter D2 with an open bottom. The cover 10 is positioned relative to the body 105 by means of a flange 170*a*. As shown, a space hermetically sealed with packing 173 and packing 174 is defined between the first cylinder portion and the body 105. The cover 170 also defines a through-hole 172 (second hole), which is located at a surface defining the hermetically sealed space. The maximum load pressure PLS supplied to the PLS port 183 is guided into the cover 170 through the through-hole 172.

The control valve 110 comprises the cylindrical piston having a diameter D4, under which the metering orifice 159 of the diameter D3 is located. The control valve 110 is composed of the holes 150, 151, 152, 154 and 156, reduced-diameter portion 153, piston 155, and engagement portion 157.

The reduced-diameter portion 153 of a cylindrical shape has at least an extent in which the control valve 110 passes the through-hole 172 of the cover 170 as it moves vertically.

The hole 152 extends from an appropriate place on the reduced-diameter portion 153 toward the center axis. The hole 151 extends vertically so as to intersect the hole 152 and has a closed upper end. The hole 154 extends horizontally so as to intersect the hole 156 in communication with the holes 151 and 150 and with the metering orifice 159.

The piston 155 is accommodated within the hole 154 so as to be capable of sliding horizontally in an airtight condition. The hole 150 extends vertically so as to intersect the hole 154 and communicate with the pressure chamber 164. The hole 156 extends vertically so as to intersect the hole 154 and communicate with the flow path 130 via the periphery of the metering orifice 159.

The engagement portion 157 is an annularly projecting portion located above the metering orifice 159. As shown, the engagement portion 157 is shaped so that the diameter thereof increases as it extends upwardly, and is designed to abut the upper end of the third cylinder portion having the diameter D3 and the depth L3 of the body 105.

The control valve 110 has a peripheral portion as shown in the figure. The peripheral portion has a sufficient length to completely close the flow paths 131 and 132 when the engagement portion 157 is in contact with the stepped portion intermediate between the second cylinder portion and the third cylinder portion. That is, even when the engagement portion 157 is in contact with the stepped portion intermediate between the second cylinder portion and the third cylinder portion, the hole 154 lies at the location shown, namely at such a place that the hole 154 does not descend to a level below the cover 170.

The aforementioned peripheral portion is provided with a notch portion 160 and a flow path 161. The notch portion 160 and the flow path 161 communicate with the flow paths 132 and 131 and with the hole 154.

When the pressure in the flow path 130 becomes lower than the pressure in the flow paths 132 and 131, the engagement portion 157 interrupts the communication between the flow path 130 and the flow paths 131 and 132 to prevent hydraulic fluid from flowing back from the flow paths 131 and 132 to the flow path 130. At this time, a conical portion located at the stepped portion intermediate between the second cylinder portion and the third cylinder portion functions as a valve seat.

The aforementioned metering orifice 159 is located on the lower side of the engagement portion 157. The metering orifice 159 causes the flow path 130 to communicate with the flow paths 131 and 132. The area of opening of the metering orifice 159 increases as the control valve 110 ascends.

The metering orifice 159 operates to hold constant the difference between the pressure P11 of hydraulic fluid flowing in the flow path 130 and the pressure at the pump port 120.

The flow rate control characteristic of the control valve 110 relative to a load pressure can be adjusted by adjusting the relationship as to whether larger or smaller between the area SD4 of the surface on which the maximum load pressure PLS works and the area SD3 of the surface on which the pressure P1 of hydraulic fluid flowing in the flow path 130 works.

Specifically, if SD4>SD3 (for example, if SD4 is made about 1–10% larger than SD3), the amount of correction made by the metering orifice 159 is limited depending on the load pressure. On the other hand, if SD4<SD3 (for example, if SD4 is made about 1–10% smaller than SD3), hydraulic fluid is shunted in an amount larger than the flow rate to be controlled when SD4=SD3, so that an excessive correction is made by the metering orifice 159. If SD4=SD3, a standard load sensing system having a flow rate control characteristic that is not dependent on the load pressure, is constituted.

Figure 4:
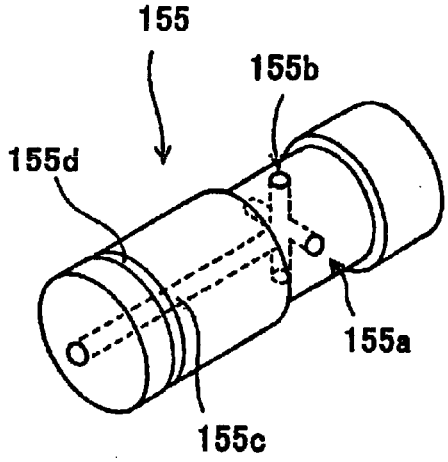
FIG. 4 is a perspective view of a piston included in the control valve.

FIG. 4 is a perspective view of the piston 155.

The piston 155 has a cylindrical reduced-diameter portion 155*a* defining a cross-shaped hole 155*b* as shown in the figure. The piston 155 further has a hole 155*c* in communication with the crossing of the hole 155*b*, and a fluid groove 155*d* for hydraulic balancing. The position and length of the reduced-diameter portion 155*a* are set so that, when the piston 155 is positioned on the left-hand side of the hole 154 in FIG. 3, the holes 156 and 151 communicate with each other, while when the piston 155 is positioned on the right-hand side of the hole 154 in FIG. 3, the holes 156 and 150 communicate with each other.

Hydraulic fluid inputted to the hole 154 via the PLS port 183, reduced-diameter portion 171, hole 172, reduced-diameter portion 153, hole 152 and hole 151 (the pressure of the hydraulic fluid is the maximum load pressure PLS.) is supplied to a chamber situated on the left-hand side of the hole 154 via the reduced-diameter portion 155*a*, cross-shaped hole 155*b* and hole 155*c* of the piston 155. By the hydraulic fluid thus supplied, the piston 155 is moved to the right or left in FIG. 3 depending on the relationship as to whether higher or lower between pressures working thereon.

On the other hand, hydraulic fluid in the flow path 132 (the pressure of the hydraulic fluid is the pressure P21) is supplied to a chamber situated on the right-hand side of the hole 154 via the notch portion 160 and flow path 161. By the hydraulic fluid thus supplied, the piston 155 is moved to the right or left in FIG. 3 depending on the relationship as to whether higher or lower between pressures working thereon. In this way the piston 155 operates independently of the metering orifice 159.

Referring to FIG. 3 again, there is shown the piston 155 in a state assumed when the pressure P21 in the flow path 132 is higher than a maximum load pressure PLS working at other hydraulic control units consisted of directional control valves in the system 1.

In this case, the hole 156 extending upwardly of the metering orifice 159 is connected to the holes 151 and 152 via the piston 155, so that hydraulic fluid in the flow path 130 (the pressure of the hydraulic fluid is the pressure P11) is supplied to the PLS port 183. Hydraulic fluid in the flow path 132 (the pressure of the hydraulic fluid is the pressure P21.) is guided to the pressure chamber 164 via the notch portion 160 and flow path 161. By these operations the maximum load pressure PLS in the hydraulic control system 1 is renewed by replacement with the value of pressure P21. The maximum load pressure PLS is reduced to the value of pressure P21 as will be described later.

The piston 155 stops at a point slightly apart rightwards from the left extremity as shown in the figure. This is because the area of a portion through which the holes 156 and 151 communicate with each other is adjusted. Specifically, hydraulic fluid passes through the restricting portion having an area adjusted and flows to the tank line 511 through the PLS line 18 and the throttle valve 21. At this time the pressure of the hydraulic fluid is reduced. Stated otherwise, the pressure guided to the left-hand side portion of the hole 154 becomes equal to the pressure P21 guided to the right-hand side portion of the hole 154, thereby balancing the forces working on the piston 155. In this case the reduced-diameter portion 155*a* of the piston 155 is positioned so as not to provide communication between the holes 150 and 151.

Figure 5:
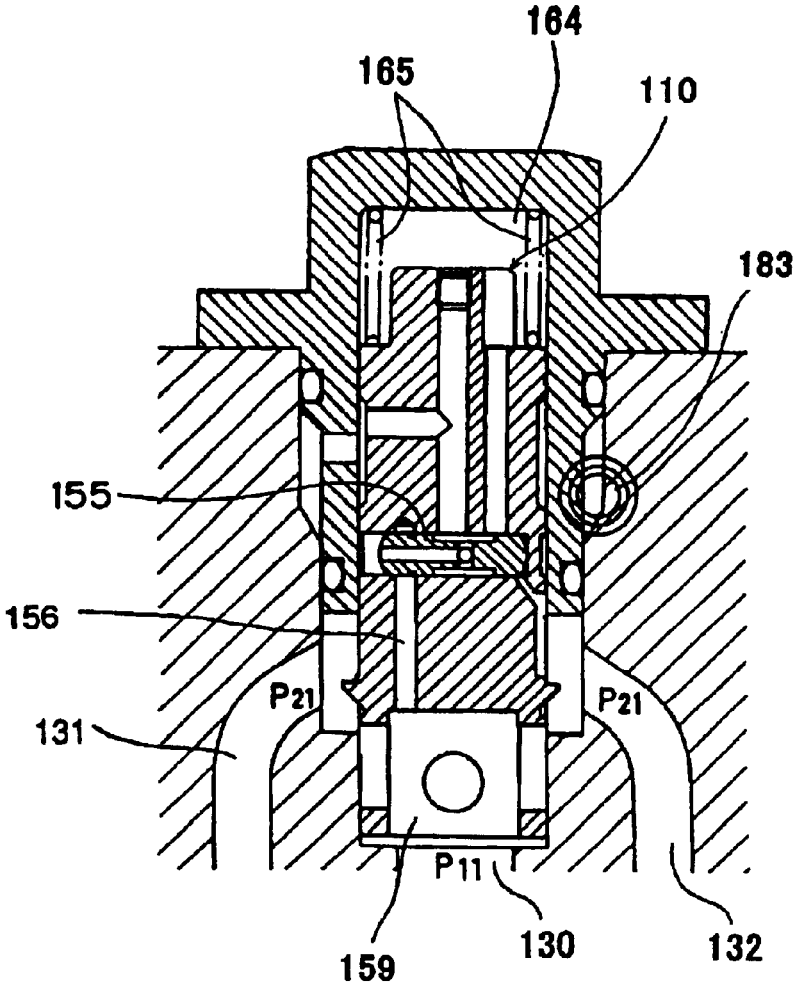
FIG. 5 is a view illustrating the control valve in a certain state.

FIG. 5 shows the piston 155 in a state assumed when the maximum load pressure PLS is higher than the pressure P21 in the flow path 132.

In this case, the hole 156 extending upwardly of the metering orifice 159 is closed by the piston 155, so that hydraulic fluid fed through the PLS port 183 (the pressure of the hydraulic fluid is equal to the value of maximum load pressure PLS.) is guided to the pressure chamber 164 through the hole 151 and the hole 150.

In this case the control valve 110 locates to such an extent as to adjust the opening of the metering orifice 159 by an amount corresponding to the magnitude of the pressure P11 in the flow path 130. That is, the pressure P11 is adjusted so as to cause the pressure in the pressure chamber 164 to balance with the sum of the force working on the control valve 110 and the spring force of the spring 165.

As described above, the use of the aforementioned control valve 110 makes it possible to constantly adjust the maximum load pressure PLS independently of the pressure controlling operation of the metering orifice 159. Further, the provision of the engagement portion 159*a* functioning as a check valve above the metering orifice 159 enables the hydraulic control unit 100 to be reduced in size.

(4) Example of Actual Operation

Figure 6:
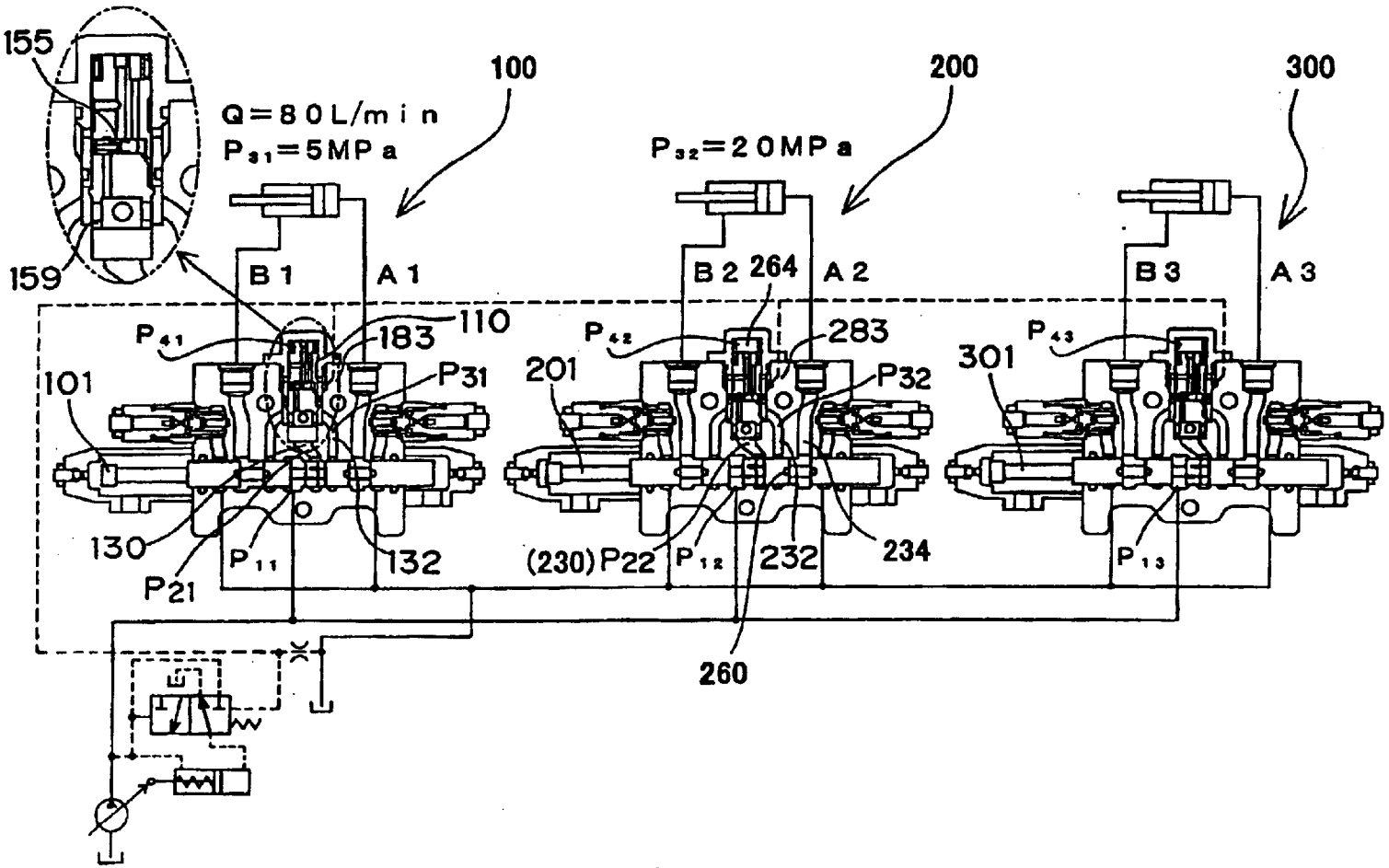
FIG. 6 is a view illustrating an actual operating state of the hydraulic control unit in the hydraulic control system.
Figure 7:
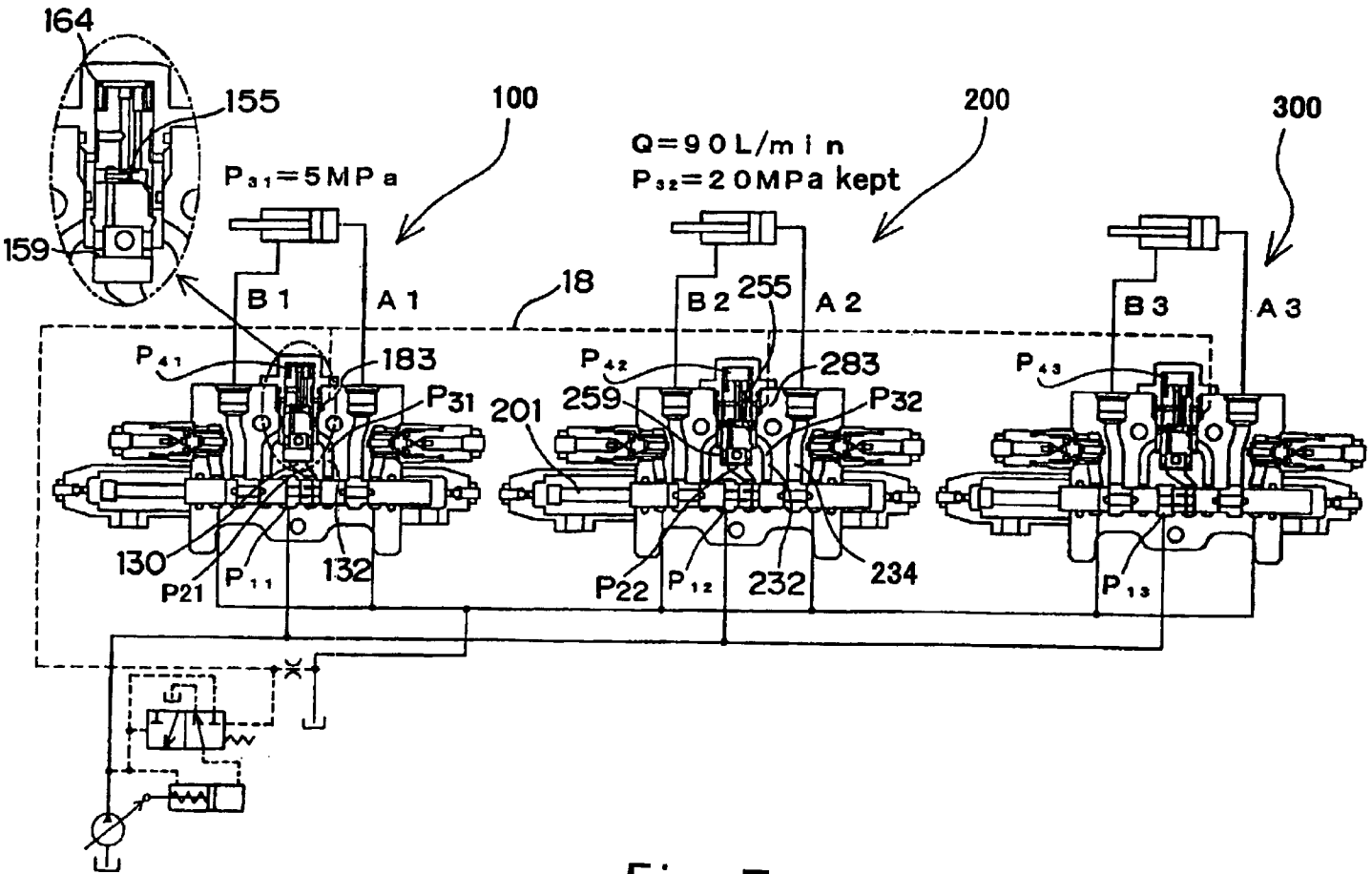
FIG. 7 is a view illustrating an actual operating state of the hydraulic control unit in the hydraulic control system.
Figure 8:
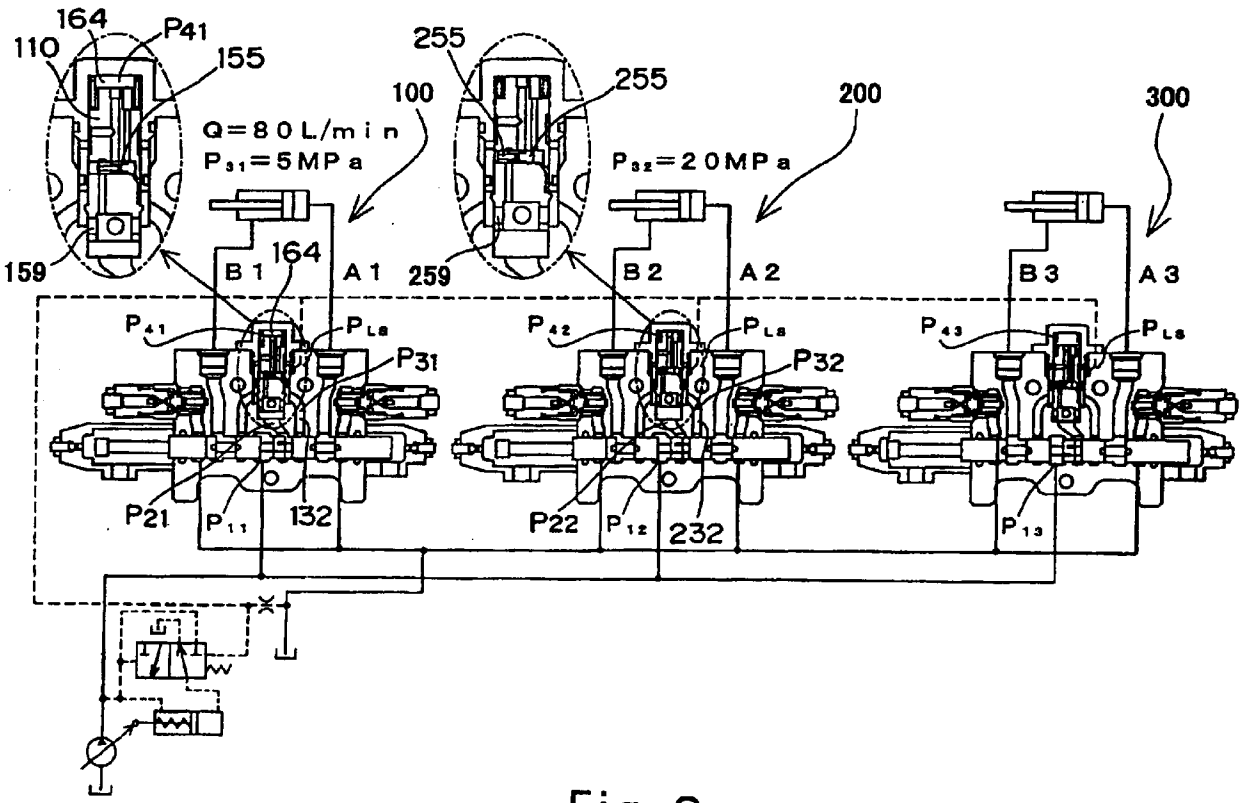
FIG. 8 is a view illustrating an actual operating state of the hydraulic control unit in the hydraulic control system.

FIGS. 6 to 8 are views illustrating actual operating states of the hydraulic control system 1 employing the aforementioned hydraulic control units 100, 200 and 300. For ease of understanding, like parts of the hydraulic control unit 200 and like parts of the hydraulic control unit 300 corresponding to the parts of the hydraulic control unit 100 having been already described are denoted by like reference numerals renumbered on the orders of 200 and 300, respectively.

FIG. 6 illustrates an operating state where only the hydraulic control unit 100 (first unit) is operating. More specifically, FIG. 6 illustrates a state where the spool valve 101 of the hydraulic control unit 100 is in a position slid to the right by a predetermined amount L1 while the spool valves 201 and 301 of the other two hydraulic control units 200 and 300 are in their respective neutral positions.

In this state the hydraulic control unit 100 is supplied with hydraulic fluid at, for example, 80 liters/min from the variable displacement pump 11. The hydraulic control unit 100 is connected to a load of 5 MPa for example. Therefore, pressure P31 in the flow path 132 is 5 MPa.

The hydraulic control unit 200 (second unit) is connected to a load of 20 MPa for example. Therefore, pressure P32 in flow path 232 is 20 MPa. The hydraulic control unit 300 (third unit) is in an unloaded condition. In the state of interest, the metering orifice 159 is in equilibrium at the maximum opening position (see the relevant enlarged view).

Since only the hydraulic control unit 100 is in the controlling state, the pressure of hydraulic fluid supplied thereto assumes its maximum with the piston 155 being balanced therewith at a position slightly apart rightwards from the left extremity, while the pressure P21 in the flow path 130 is reduced a little to assume the value of P31. The value of pressure P31 is equal to the maximum load pressure PLS (=P41).

FIG. 7 shows a state changed from the state shown in FIG. 6, where the spool valve 201 of the hydraulic control unit 200 is in a position slid to the right by a predetermined amount L1. The hydraulic control unit 200 is supplied with hydraulic fluid at, for example, 90 liters/min from the variable displacement pump 11.

As described above, the hydraulic control unit 200 is connected to a load of 200 MPa, and the sliding of the spool valve 201 causes flow paths 232 and 234 to communicate with each other and, accordingly, the aforementioned load pressure works on the rightmost end of hole 254 via the flow path 232, notch portion 260 and flow path 261. (Though not shown in FIG. 7, these reference numerals are renumbered on the order of 200 from the corresponding numerals used in FIGS. 2 and 3, and hereinafter the same.)

For this reason piston 255 is moved to the left to guide the aforementioned load pressure into pressure chamber 264 through hole 250. Further, flow path 230 (inlet port of metering orifice 259) becomes connected to PLS port 283 via hole 256, reduced-diameter portion 255*a* of the piston 255, hole 251 and hole 252.

Further, the sliding of the spool valve 201 causes pump port 220 and flow path 230 to communicate with each other through a variable orifice. At this time only the pressure corresponding to the load imposed on the hydraulic control unit 100 works on the pump port 220 and, therefore, pressure P22 in the flow path 230 is lower than pressure P42 (the pressure in the pressure chamber 264), i.e. P22<P42. Control valve 210 descends to make engagement portion 257 abut the seat portion of body 205, thereby preventing backflow from flow path 232 to flow path 230.

By the control valve 210 interrupting the communication between flow paths 230 and 232, the flow of hydraulic fluid in flow path 230 is stopped. For this reason the pressure P22 in flow path 230 becomes equal to the pressure P21 at the pump port 220. Since the flow path 230 communicates with the PLS port 283 as described above and the PLS port 283 communicates with the PLS port 183 of the hydraulic control unit 100, the pressure P22 (=P12) in the flow path 232 is guided to the PLS port 183 and then further guided to the left-hand side of the hole 154 accommodating the piston 155 via the hole 172, hole 152, hole 151, reduced-diameter portion 155*a* of the piston 155 and hole 155*c*.

On the other hand, the pressure P31 in flow path 132 works on the right-hand side of the hole 154, and the pressure P22 is higher than pressure P31, i.e. P22 (=P12) >P31. For this reason, piston 155 moves to the right as shown in the figure to interrupt the communication between the holes 151 and 156 as well as to provide communication between the holes 151 and 150. Therefore, the pressure P22 (=P12) at the PLS port 183 is guided into the pressure chamber 164.

The pressure P22 guided into the pressure chamber 164 is equal to the pressure P11 at the pump port 120. The pressure P21 in the flow path 130 is lower than the pressure P22 (the pressure in the pressure chamber 164=P11), i.e. P21<P22. For this reason, the control valve 110 descends to decrease the area of opening of the metering orifice 159. Accordingly, the flow from the flow path 130 to the flow path 132 is restricted to cause the pressure P21 in flow path 130 and the pressure P11 at the pump port 120 to increase.

The increased pressure P11 at the pump port 120 is guided into the pressure chamber 164 of the hydraulic control unit 100 via the PLS port 283 of the hydraulic control unit 200. As described above, when the pressures at the respective pump ports 120 and 220 increase like a chain reaction to a value higher than the load pressure working at the hydraulic control unit 200 so that the pressure P22 in the flow path 230 becomes higher than the sum of the pressure P32 (20 MPa) in the flow path 232 and F/SD4, i.e. P22 (=P11, P21)>P32+F/SD4 (wherein F is the pressure applied by spring 265 and SD4 is the area of the top surface of the control valve 210), the control valve 210 ascends to allow the flow paths 230 and 232 to communicate with each other. This means that hydraulic fluid is supplied to the associated actuator to drive it.

In this case, the pressure working at the left end of the piston 255 becomes higher by F/SD4 than the pressure working at the right end of the piston 255, which causes the piston 255 to move to the right. At this time the area of opening of the flow path allowing the hole 256 to communicate with the reduced-diameter portion 255*a* of the piston 255 decreases and, hence, the pressure working at the left end of the piston 255 is reduced. When the piston 255 moves to a position at which the pressure working at the left end of the piston 255 becomes equal to the pressure P32, i.e. P22-F/SD4=P32, the pressure working at the left end of the piston 255 becomes balanced with the pressure P32 working at the right end of the piston 255 and, hence, the piston 255 is held at that position.

Thus, the PLS port 283 is maintained as connected to the flow path 230 and a pressure reduced to the value of pressure P32 (load pressure) in the flow path 232 is guided to the PLS port 283. Since the PLS port 283 communicates with the pressure chamber 164 of the hydraulic control unit 100 via the PLS line 18, the control valve 110 is controlled on the basis of the load pressure working at the hydraulic control unit 200.

By controlling the control valves 110, 210 and 310 on the basis of the maximum load pressures of the respective hydraulic control units, the actuators connected to the respective hydraulic control units can be operated simultaneously.

FIG. 8 shows a state changed from the state shown in FIG. 7. In the hydraulic control unit 100 the pressure P41 in pressure chamber 164 increases further. This results in a state where P41+F/S=P21 (wherein F/S is the spring force), and therefore the pressure P21 increases with increasing pressure P41. After a chain of increases in pressure, the metering orifice 159 begins descending to perform the compensating operation.

Eventually, the metering orifice 259 of the hydraulic control unit 200 also becomes open and the pressure P32 (20 MPa) is guided to the pressure P42, resulting in a state where P22=P32(20 MPa)+F/SD4 (wherein F is the pressure applied by the spring 265 and SD4 is the area of the top surface of control valve 110).

In this case the metering orifice 259 is fully open. Further, the pressure PLS assumes a value of 20 MPa as the metering orifice 159 of the hydraulic control unit 100 operates and, hence, the hydraulic control unit 200 becomes capable of supplying hydraulic fluid. The piston 255 adjusts the pressure at its left end so that a state where P22−F/SD4=P32 is assumed, and reaches an equilibrium at a position slightly apart from the left extremity.

Second Embodiment

Next, the second embodiment of the present invention will be described below.

Figure 9:
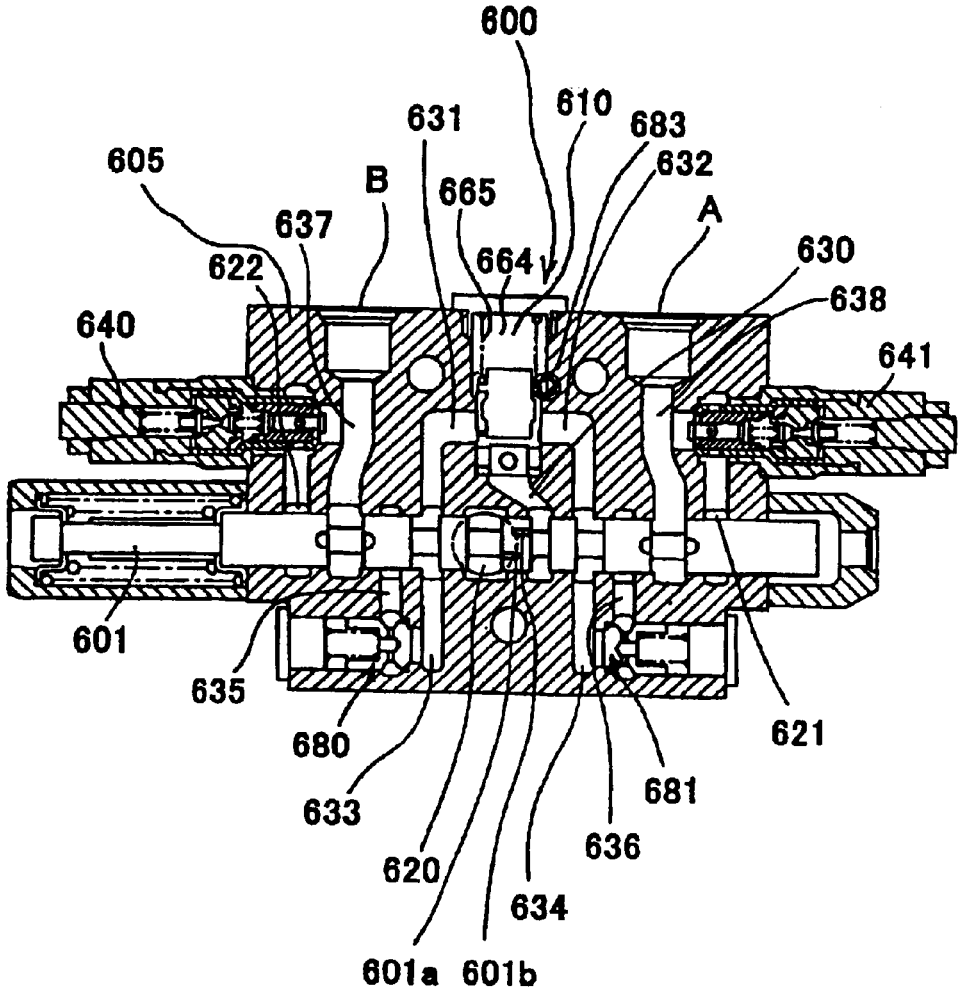
FIG. 9 is a view showing the construction of a hydraulic control unit according to a second embodiment of the present invention.

FIG. 9 is a view showing the construction of a hydraulic control unit 600 according to the second embodiment of the present invention. This hydraulic control unit 600 includes an integral-type hydraulic control valve 610 and is adapted for use in a several-directional-control-valves-assembled-type hydraulic control system having a load sensing function like the above-described first embodiment.

The hydraulic control unit 600 includes a body 605, a spool valve 601, flow paths 630 to 638 intersecting the spool valve 601, a pump port 620, tank ports 621 and 622, a maximum load pressure PLS port 683, the aforementioned hydraulic control valve 610 biased downwardly in the figure by a spring 665, relief valves 640 and 641, a port A, and a port B.

The pump port 620 is supplied with hydraulic fluid of a predetermined pressure from a variable displacement hydraulic pump included in the aforementioned hydraulic control system. The PLS port 683 is supplied with hydraulic fluid of a maximum load pressure PLS detected within the hydraulic control system.

The construction of the control valve 610 and that of a portion thereabout, which are characteristic of the hydraulic control unit 600, will be described in detail with reference to an enlarged view (FIG. 11) later.

As shown, the spool valve 601 has a plurality of reduced-diameter portions and a notch portion serving as a metering orifice. When the spool valve 601 slides to the left in the figure, the pump port 620 and the flow path 630 are allowed to communicate with each other. As the amount of sliding of the spool valve 601 increases, variable orifices 601*a* and 601*b* open increasingly to feed larger amounts of hydraulic fluid therethrough. The sliding of the spool valve 601 provides communications between the flow path 632 and the flow path 634 and between the flow path 636 and the flow path 638. Further, the sliding of the spool valve 601 causes communications between the flow path 638 and the tank port 621 and between the flow path 635 and the flow path 637 to be interrupted. Moreover, the sliding of the spool valve 601 allows the flow path 637 and the tank port 621 to communicate with each other.

When the spool valve 601 slides to the left in the figure, hydraulic fluid fed to the pump port 620 is supplied to the port A, passing through the flow path 630, control valve 610, flow path 632, flow path 634, check valve 681, flow path 636 and flow path 683. The port A is connected to an actuator not shown. Hydraulic fluid returning to the port B from this actuator is discharged to the tank port 622 through the flow path 637. It is to be noted that in the event fluid pressurized at an accidentally high pressure is produced, the relief valve 641 is actuated to prevent the spool valve 101 and the like from failing.

When the spool valve 101 slides to the right in the figure, the pump port 620 and the flow path 630 are allowed to communicate with each other. As the amount of that sliding increases, the variable orifices 601*a* and 601*b* open increasingly to feed larger amounts of hydraulic fluid therethrough. The sliding of the spool valve 601 provides communications between the flow path 631 and the flow path 633 and between the flow path 635 and the flow path 637. Further, the sliding of the spool valve 601 causes communications between the flow path 637 and the tank port 622, between the flow path 632 and the flow path 634 and between the flow path 636 and the flow path 638 to be interrupted. Furthermore, the sliding of the spool valve 601 allows the flow path 638 and the tank port 621 to communicate with each other.

When the spool valve 601 slides to the right in the figure, hydraulic fluid fed to the pump port 620 is supplied to the port B, passing through the flow path 630, control valve 610, flow path 631, flow path 633, check valve 680, flow path 635 and flow path 637. The port B is connected to the actuator not shown. Hydraulic fluid returning to the port A from the actuator is discharged to the tank port 621 through the flow path 638. It is to be noted that in the event fluid pressurized at an accidentally high pressure is produced, the relief valve 641 is actuated to prevent the spool valve 601 and the like from failing.

Since the shape and the operation of the spool valve 601 are not characteristic of the hydraulic control unit 600, further description thereof is omitted.

Figure 10:
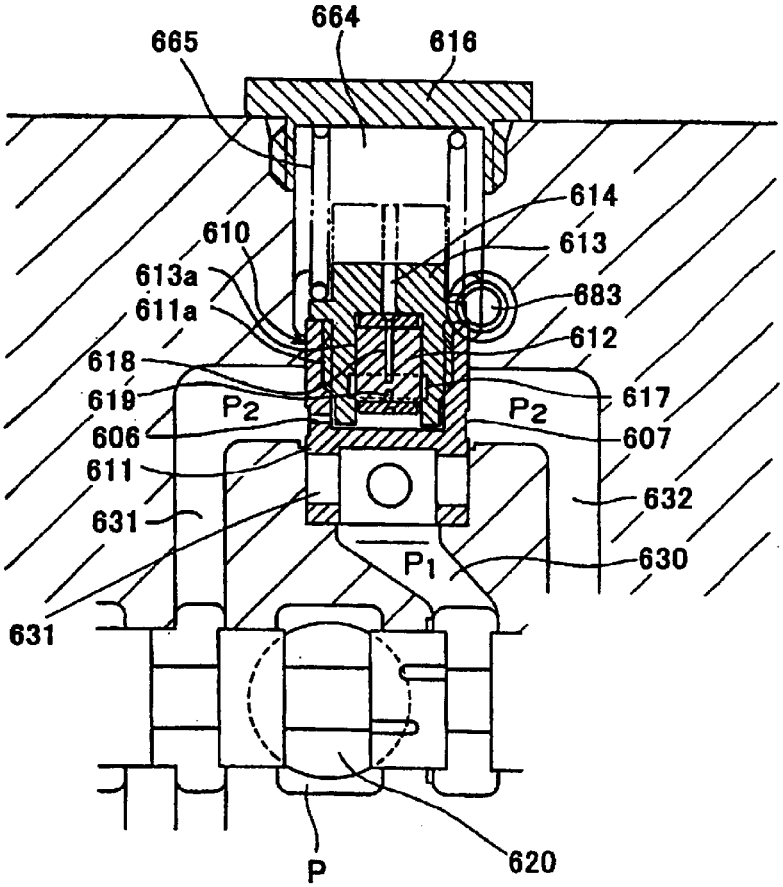
FIG. 10 is an enlarged view of a portion around a control valve according to the second embodiment of the present invention.

FIG. 10 is an enlarged view of the portion around the control valve 610 shown in FIG. 9.

The control valve 610 is accommodated between a cylinder of a predetermined shape provided in the body 605 and a cover 616. As will be described later, to a pressure chamber 664 is guided hydraulic fluid of the highest load pressure PLS among pressures guided from respective flow paths 631 and 632 and maximum load pressures working at other units guided from the PLS port 683 within the hydraulic control system.

The control valve 610 is biased downwardly with a force as the sum of the maximum load pressure PLS and the elastic force F of the spring 165 determined by the position of the control valve 610. By the operation of a compensator 611 the control valve 610 is adjusted so that the pressure P1 in the flow path 630 balances with the sum of the maximum load pressure PLS in the pressure chamber 664 and the pressure based on the elastic force F of the spring 615 (hereinafter referred to as "PLS+F/S", wherein S is the area of a working surface).

The control valve 610 is composed of the three parts: compensator 611, piston 612 and cover 613. The compensator 611 has an open portion 611*d* (metering orifice). This open portion 611*d* provides communication between the flow path 630 and the flow paths 631 and 632 while increasing the area of its opening as the control valve 610 ascends. The open portion 611*d* functions as a metering orifice to hold constant the difference between the pressure P at the pump port 620 and the pressure P1 of hydraulic fluid flowing in the flow path 630.

A cylinder portion 611*a* of a predetermined diameter with an upwardly oriented opening is provided above the compensator 611. The cylinder portion 611*a* defines a horizontal hole 606 in a bottom portion thereof. The cylinder portion 611*a* has a reduced-diameter portion 607 in a portion formed with the horizontal hole 606.

In the state shown in FIG. 10 the cylinder portion 611*a* communicates with the flow paths 631 and 632 via the reduced-diameter portion 607 and the hole 606. It should be noted that instead of the provision of the reduced-diameter portion 607, it is possible to employ an arrangement having a hole through which the cylinder portion 611*a* and the flow path 632 communicate with each other.

As shown, the piston 612 is accommodated between the cylinder portion 611*a* located above the aforementioned compensator 611 and the cover 613 of a cylindrical shape. The cover 613 is secured (screwed) to the compensator 611 with a predetermined clearance from the bottom surface of the cylinder portion 611*a* to allow hydraulic fluid to flow into the inside.

A cylinder portion 613*a* is provided inside the cover 613 as shown in the figure. The cylinder portion 613*a* accommodates the piston 612 for sliding in an airtight condition. The cylinder portion 613*a* has a cylindrical recess 617. This recess 617 is situated at such a location as to provide communication between upper groove 618 and lower groove of the piston 612. The cover 613 defines a vertical hole 614 extending therethrough upwardly from the cylinder portion 613*a*.

Figure 11:
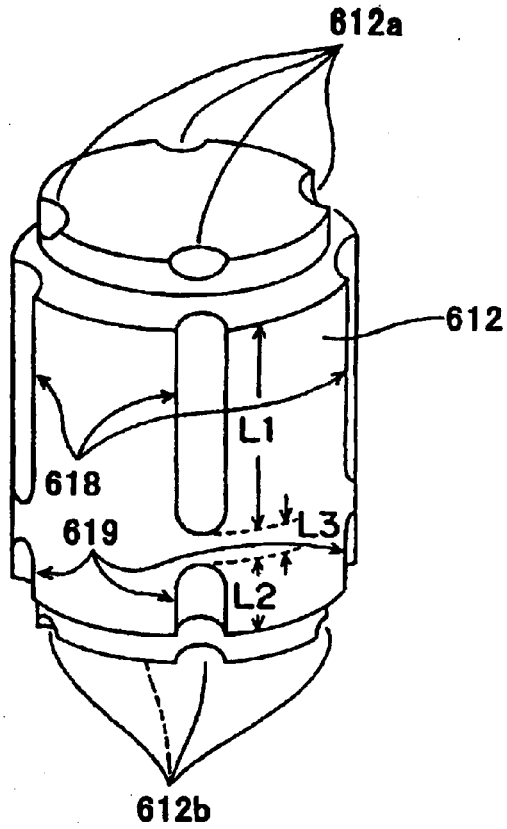
FIG. 11 is a perspective view of a piston according to the second embodiment of the present invention.

FIG. 11 is a perspective view of the piston 612.

As shown, the piston 612 is shaped cylindrical having reduced-diameter portions at upper and lower ends thereof. The upper and lower reduced-diameter portions define notch portions 612*a* and notch portions 612*b*, respectively, at intervals of 90 degrees. On the other hand, the larger-diameter portion defines the upper grooves 618 each having a length L1 and the lower grooves 619 each having a length of L2 at intervals of 90 degrees.

Spacing L3 between the upper grooves 618 and the lower grooves 619 is established smaller than the vertical dimension of the cylindrical recess 617 located inside the cover 613. The notch portions 612*a* and 612*b* defined in the respective upper and lower reduced-diameter portions function to make the pressure of hydraulic fluid entering through the hole 606 easy to work on the top and bottom surfaces of the piston 612.

The piston 612 slides vertically, independently of the compensator 611. Specifically, the piston 612 slides depending on whether the maximum load pressure PLS at the other units in the hydraulic control system, which is guided through the hole 614, is higher or lower than the pressure P2 in the flow path 632, which is guided through the hole 606.

Figure 12:
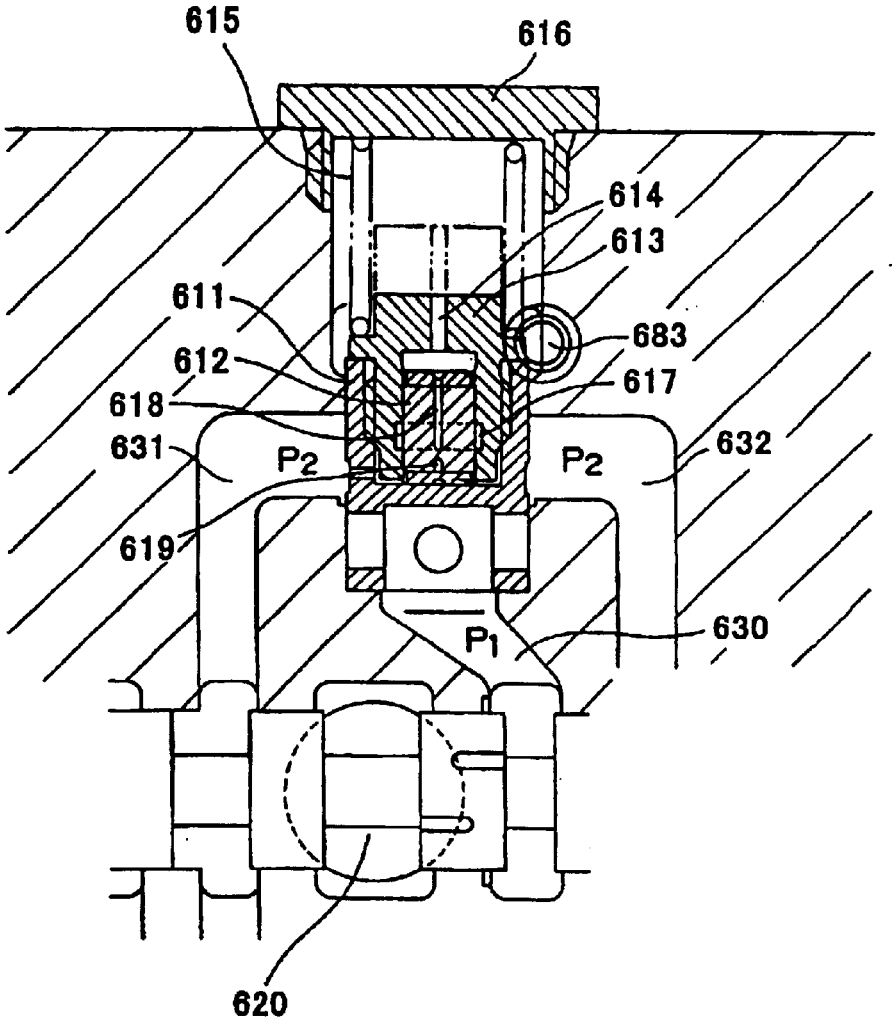
FIG. 12 is a view illustrating one example of an operation of the piston according to the second embodiment of the present invention.
Figure 13:
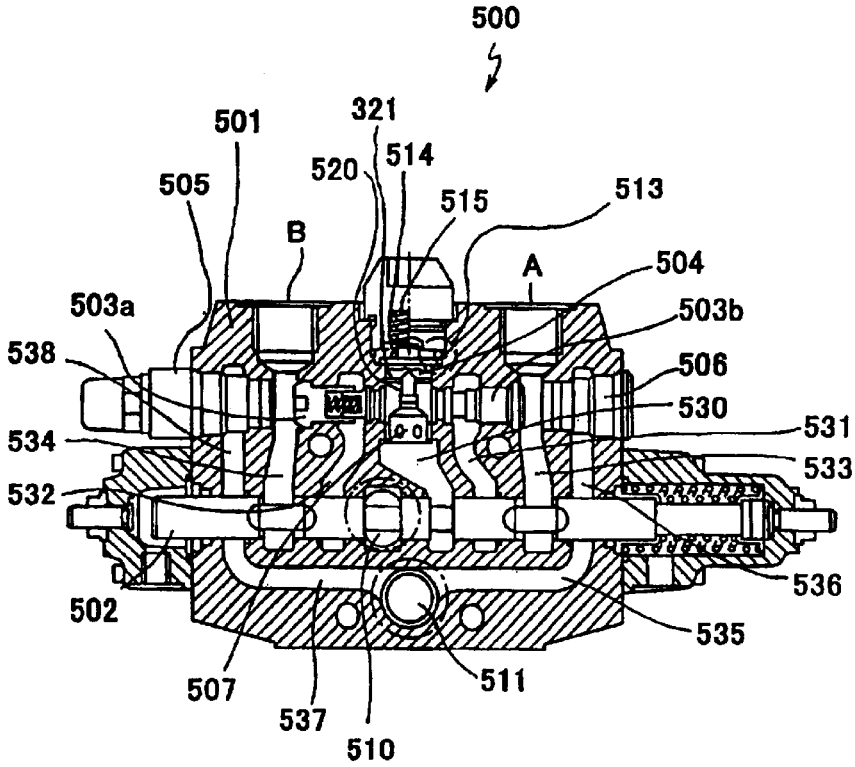
FIG. 13 is a sectional view showing the construction of a conventional hydraulic control unit.

When the pressure P2 in the flow path 632 is higher than the maximum load pressure PLS, the piston 612 ascends to the highest level within the cylinder of the cover 613 as shown in FIG. 12. In this case, the lower grooves 619 formed at the periphery of the piston 612 come to communicate with the upper grooves 618 through the cylindrical recess 617 of the cover 613. This causes the pressure P2 in the flow path 632 to be transmitted to the PLS port 683 via the hole 614 and the pressure chamber 664, thereby renewing the maximum load pressure PLS of the hydraulic control system by replacement with the value of the pressure P2.

FIG. 12 shows an example of a state of the piston 612 assumed when the maximum load pressure PLS guided through the PLS port 683 is higher than the pressure P2 in the flow path 632. In this case, the communication between the lower grooves 619 and upper grooves 618 formed at the periphery of the piston 612 is interrupted.

The use of the control valve 610 having the construction thus described makes it possible to adjust the peal load pressure PLS constantly, independently of the pressure control operation performed by the compensator 611. Thus, it is possible to prevent the occurrence of a deviation between the maximum load pressure PLS in the hydraulic control system and an actual maximum load pressure PLS (=P2) in a hydraulic control unit included in the hydraulic control system, thereby preventing the occurrence of hunting induced by such a deviation.

INDUSTRIAL APPLICABILITY

The hydraulic control unit according to the present invention includes the shuttle valve (selector valve) which operates independently of the compensator and hence is capable of renewing the maximum load pressure based on which displacement of the variable displacement pump is controlled in the hydraulic control system. Therefore, the occurrence of hunting can be inhibited by shortening the duration of the occurrence of a deviation between a maximum load pressure PLS applied to the pump and an actual maximum load pressure in the hydraulic control unit. Further, since the aforementioned shuttle valve is incorporated in the compensator, the size of the control unit can be reduced.

What is claimed is:

1. A hydraulic control unit for use in a several-directional-control-valves-assembled-type hydraulic control system having a plurality of actuators to be controlled by a variable displacement pump and provided with a load sensing function to detect a maximum load pressure, which is the highest one of load pressures working at the respective actuators, and to control a delivery pressure of the variable displacement pump so that the delivery pressure becomes higher by a predetermined value than the maximum load pressure detected, the hydraulic control unit having a maximum load pressure port to which the maximum load pressure in the hydraulic control system is supplied, the hydraulic control unit being characterized by comprising:

a compensator including an input port connected to a first flow path communicating with a pump port through a variable orifice, an output port connected to a second flow path communicating with an output port of the hydraulic control unit connected to a predetermined one of the actuators, and a metering orifice having a variable opening for controlling a pressure in the first flow path according to a pressure in the second flow path, and a pressure chamber operative to exert a force in such a direction as to close the metering orifice; and a directional control valve which operates independently of the variable orifice and the compensator, and which reduces the pressure in the first flow path to the pressure in the second flow path and guides the pressure thus reduced to the maximum load pressure port when the pressure in the second flow path is higher than a maximum load pressure working at other hydraulic control units in the hydraulic control system, wherein:

the directional control valve is incorporated in the compensator, and the directional control valve has a function of sliding due to a deviation between the pressure at the maximum load pressure port and the pressure in the second flow path and guiding the pressure in the first flow path to the maximum load pressure port for use as the maximum load pressure by the sliding thereof, and a function of guiding the pressure at the maximum load pressure port to the pressure chamber of the compensator to close the metering orifice by the sliding thereof.

2. The hydraulic control unit according to claim 1, wherein the selector valve comprises:

a first hole connected to the first flow path;

a second hole connected to the maximum load pressure port; and a selector valve which operates according to whether the pressure in the second flow path is higher or lower than the maximum load pressure supplied to the maximum load pressure port independently of the variable orifice and the compensator, which selector valve provides communication between the first hole and the second hole when the pressure in the second flow path is higher than the maximum load pressure working at the other hydraulic control units in the hydraulic control system, and which selector valve is provided with a flow path for guiding the maximum load pressure working at the other hydraulic control units in the hydraulic control system to the second hole while closing the first hole when the pressure in the second flow path is lower than the maximum load pressure working at other hydraulic control units in the hydraulic control system.

3. The hydraulic control unit according to claim 2, further comprising a check valve disposed between the input port and the output port of the compensator for blocking backflow of pressurized fluid from the second flow path to the first flow path.

4. The hydraulic control unit according to claim 3, wherein the directional control valve comprises:

a first hole connected to the second flow path;

a second hole connected to the maximum load pressure port; and a piston which slides according to whether the pressure in the second flow path is higher or lower than the maximum load pressure supplied to the maximum load pressure port independently of the compensator, which piston provides communication between the first hole and the second hole when the pressure in the second flow path is higher than the maximum load pressure working at the other hydraulic control units in the hydraulic control system, and which piston is provided with a flow path for guiding the maximum load pressure working at the other hydraulic control units in the hydraulic control system to the second hole while interrupting the communication between the first hole and the second hole when the pressure in the second flow path is lower than the maximum load pressure working at the other hydraulic control units in the hydraulic control system.

5. The hydraulic control unit according to claim 1, further comprising a check valve disposed between the input port and the output port of the compensator for blocking backflow of pressurized fluid from the second flow path to the first flow path.

6. The hydraulic control unit according to claim 5, wherein the compensator has a first surface on which the pressure in the first flow path works, an opposite second surface which has a larger area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

7. The hydraulic control unit according to claim 5, wherein the compensator has a first surface on which the pressure in the first flow path works, an opposite second surface which has a smaller area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

8. The hydraulic control unit according to claim 3, further comprising a check valve disposed between the input port and the output port of the compensator for blocking backflow of pressurized fluid from the second flow path to the first flow path.

9. The hydraulic control unit according to claim 8, wherein the compensator has a first surface on which the pressure in the first flow path works, an opposite second surface which has a larger area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

10. The hydraulic control unit according to claim 3, wherein the compensator has a first surface on which the pressure in the first flow path works, an opposite second surface which has a larger area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

11. The hydraulic control unit according to claim 3, wherein the compensator has a first surface on which the pressure in the first flow path works, an opposite second surface which has a smaller area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

12. The hydraulic control unit according to claim 2, further comprising a check valve disposed between the input port and the output port of the compensator for blocking backflow of pressurized fluid from the second flow path to the first flow path.

13. The hydraulic control unit according to claim 12, wherein the compensator has a first surface on which the pressure in the first flow path works, an opposite second surface which has a larger area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

14. The hydraulic control unit according to claim 12, wherein the compensator has a first surface on which the pressure in the first flow path works, an opposite second surface which has a smaller area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

15. The hydraulic control unit according to claim 2, wherein the directional control valve comprises:

a first hole connected to the second flow path;

a second hole connected to the maximum load pressure port; and a piston which slides according to whether the pressure in the second flow path is higher or lower than the maximum load pressure supplied to the maximum load pressure port independently of the compensator, which piston provides communication between the first hole and the second hole when the pressure in the second flow path is higher than the maximum load pressure working at the other hydraulic control units in the hydraulic control system, and which piston is provided with a flow path for guiding the maximum load pressure working at the other hydraulic control units in the hydraulic control system to the second hole while interrupting the communication between the first hole and the second hole when the pressure in the second flow path is lower than the maximum load pressure working at the other hydraulic control units in the hydraulic control system.

16. The hydraulic control unit according to claim 2, wherein the compensator has a first surface on which the pressure in the first flow path works, an opposite second surface which has a larger area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

17. The hydraulic control unit according to claim 2, wherein the compensator has a first surface on which the pressure in the first flow path works, an opposite second surface which has a smaller area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

18. The hydraulic control unit according to claim 1, further comprising a check valve disposed between the input port and the output port of the compensator for blocking backflow of pressurized fluid from the second flow path to the first flow path.

19. The hydraulic control unit according to claim 3, further comprising a check valve disposed between the input port and the output port of the compensator for blocking backflow of pressurized fluid from the second flow path to the first flow path.

20. The hydraulic control unit according to claim 19, wherein the compensator has a first surface on which the pressure in the first flow path works, an opposite second surface which has a larger area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

21. The hydraulic control unit according to claim 19, wherein the compensator has a first surface on which the pressure in the first flow path works, an opposite second surface which has a smaller area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

22. The hydraulic control unit according to claim 18, wherein the compensator has a first surface on which the pressure in the first flow path works, an opposite second surface which has a larger area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

23. The hydraulic control unit according to claim 18, wherein the compensator has a first surface on which the pressure in the first flow path works, an opposite second surface which has a smaller area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

24. The hydraulic control unit according to claim 8, wherein the compensator has a first surface on which the pressure in the first flow path works, an opposite second surface which has a smaller area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

25. The hydraulic control unit according to claim 1, wherein the compensator has a first surface on which the pressure in the first flow path works, an opposite second surface which has a larger area than the first surface and on which the maximum load pressure inputted through the directional control valve and a predetermined spring force work, and a metering orifice which opens according to whether the force working on the second surface is larger or smaller than the force working on the first surface to provide communication between the input port and the output port of the compensator.

26. The hydraulic control unit according to claim 1, wherein the compensator has a first surface on which the pressure in the first flow path works, an opposite second surface which has a smaller area than the first surface and on which the maximum load pressure inputted through the selector valve and a predetermined spring force work, and a metering orifice which opens according to whether the force working on the second surface is larger or smaller than the force working on the first surface to provide communication between the input port and the output port of the compensator.

* * * * *

UNITED STATES PATENT AND TRADEMARK OFFICE

CERTIFICATE OF CORRECTION

PATENT NO. : 6,845,702 B2
DATED : January 25, 2005
INVENTOR(S) : Toyoaki Sagawa et al.

It is certified that error appears in the above-identified patent and that said Letters Patent is hereby corrected as shown below:

Title page,
Item [73], Assignee, delete "Kawasaki Jukogyo Kabushiki Kaisha" and insert -- Kabushiki Kaisha Kawasaki Precision Machinery --.

Column 9,
Line 36, delete "compensator, and" and insert -- compensator; and --.

Signed and Sealed this

Eighteenth Day of October, 2005

JON W. DUDAS
*Director of the United States Patent and Trademark Office*